US008313170B2

(12) United States Patent
Tabata et al.

(10) Patent No.: US 8,313,170 B2
(45) Date of Patent: Nov. 20, 2012

(54) FLUID EJECTION DEVICE

(75) Inventors: Kunio Tabata, Shiojiri (JP); Nobuaki Azami, Matsumoto (JP); Hiroyuki Yoshino, Matsumoto (JP); Shinichi Miyazaki, Suwa (JP); Atsushi Oshima, Shiojiri (JP); Noritaka Ide, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 468 days.

(21) Appl. No.: 12/605,466

(22) Filed: Oct. 26, 2009

(65) Prior Publication Data

US 2010/0103212 A1 Apr. 29, 2010

(30) Foreign Application Priority Data

Oct. 27, 2008 (JP) ..... 2008-275232

(51) Int. Cl.
*B41J 2/045* (2006.01)
*B41J 29/38* (2006.01)

(52) U.S. Cl. ..... 347/68; 347/9; 347/10

(58) Field of Classification Search ..... 347/10, 347/57, 9, 68
See application file for complete search history.

(56) References Cited

U.S. PATENT DOCUMENTS 6,808,242 B2 * 10/2004 Kobayashi ..... 347/12
7,049,756 B2 * 5/2006 Aiba et al. ..... 315/172
2003/0112297 A1 * 6/2003 Hiratsuka et al. ..... 347/58
2008/0238964 A1 * 10/2008 Umeda ..... 347/10

FOREIGN PATENT DOCUMENTS

JP 2003-285441 10/2003

* cited by examiner

*Primary Examiner* — Stephen Meier
*Assistant Examiner* — Sarah Al Hashimi
(74) *Attorney, Agent, or Firm* — Maschoff Gilmore & Israelsen

(57) ABSTRACT

A fluid ejection device configured to eject fluid from an ejection port includes a driving element that pressurizes the fluid and causes it to be ejected from the ejection port by being driven according to a voltage applied thereto. A driving voltage waveform selecting unit selects a driving voltage waveform to be applied to the driving element from among a plurality of types of the stored driving voltage waveforms. Power sources set the voltage to be outputted. A power source voltage determining unit determines voltages to be set to the power sources on the basis of the selected driving voltage waveform. A driving voltage waveform applying unit applies the selected driving voltage waveform to the driving element by setting the determined voltages to the power sources and connecting the power sources to the driving element while switching the same.

2 Claims, 10 Drawing Sheets

| | | SPECIFIED DRIVING VOLTAGE WAVEFORMS | |
|---|---|---|---|
| | | WAVEFORM FOR LARGE DOTS | WAVEFORM FOR SMALL DOTS |
| VOLTAGE SET VALUES OF POWER SOURCE UNIT | V1 | 10 V | 16 V |
| | V2 | 15 V | 18 V |
| | V3 | 20 V | 20 V |
| | V4 | 25 V | 22 V |
| | V5 | 30 V | 24 V |
| | V6 | 35 V | 26 V |
| | V7 | 40 V | 28 V |
| | V8 | 45 V | 30 V |

FLUID EJECTION DEVICE

This application claims priority to Japanese Patent Application No. 2008-275232 filed on Oct. 27, 2008, and the entire disclosure thereof is incorporated herein by reference.

BACKGROUND

1. Technical Field

The present invention relates to a technique to eject fluid from an ejection head.

2. Related Art

An inkjet printer configured to print an image by ejecting ink on a printing medium is now widely used as an image output apparatus because printing of high-quality images is easily achieved. Also, by ejecting various type of fluid prepared to have adequate components (for example, liquid including fine particles of functional materials dispersed therein or semifluid such as gel) instead of the ink on a substrate using this technique, manufacturing of various types of precision components such as electrodes, sensors, and biochips is considered to be easily achieved.

In the technique as described above, a specific ejection head provided with fine ejection ports is employed so as to enable ejection of fluid of accurate amount to an accurate position. The ejection head is provided with driving elements (for example, a piezoelectric element) connected to the ejection ports, and the fluid is ejected from the ejection ports by supplying a driving voltage waveform to the driving element. The amount or the shape (for example, the size of liquid drops) of fluid to be ejected from the ejection ports can be changed by controlling the driving voltage waveform to be applied to the driving element.

When an amplifier element such as a transistor for generating the driving voltage waveform, there arise problems such as power consumption due to dissipation in the amplifier element (for example, collector dissipation of the transistor) or upsizing of the device due to the necessity of a heat discharging panel for releasing heat generated by the power consumption. Accordingly, a technique to generate the driving voltage waveform without using the amplifier element by providing a plurality of power sources having voltages different from each other and changing the voltage by switching these power sources as needed is proposed (JP-A-2003-285441).

However, with the proposed technique, although high power efficiency is achieved, there is a problem of difficulty in generating an accurate driving voltage waveform. In other words, since the power efficiency is enhanced by switching the power sources, the generated driving voltage waveform assumes a stepped waveform in which the voltage is changed in a staircase pattern, so that output of an accurate waveform is difficult. However, when the driving voltage waveform is generated using the amplifier element such as the transistor, the electric power is consumed by the amplifier element, and hence the power efficiency is lowered.

SUMMARY

An advantage of some aspects of the invention is to provide a fluid ejection device which is capable of ejecting fluid accurately by outputting an adequate driving waveform while restraining power consumption, and a following configuration is employed.

A fluid ejection device according to an aspect of the invention is configured to eject fluid from an ejection port and includes:

a driving element configured to pressurize the fluid and cause the same to be ejected from the ejection port by being driven according to a voltage applied thereto;

a driving voltage waveform selecting unit configured to select a driving voltage waveform to be applied to the driving element from among a plurality of types of the stored driving voltage waveforms;

a plurality of power sources which are able to set the voltage to be outputted;

a power source voltage determining unit configured to determine voltages to be set to the plurality of power sources on the basis of the selected driving voltage waveform;

a driving voltage waveform applying unit configured to apply the selected driving voltage waveform to the driving element by setting the determined voltages to the plurality of power sources and connecting the plurality of power sources to the driving elements while switching the same.

The fluid ejection device of the aspect of the invention includes the plurality of power sources to which voltages to be outputted can be set, and when the driving voltage waveform to be applied to the driving element is selected, determines the voltages of the power sources on the basis of the driving voltage waveform. Then, the fluid ejection device outputs the determined voltages from the power sources and connects the power sources to the driving element while switching the same, so that the driving voltage waveform is applied to the driving element.

In this configuration, since the voltage of the power source can be changed according to the selected driving voltage waveform, the voltage suitable for generating the driving voltage waveform can be outputted from the power source. By outputting the voltages as described above, the driving voltage waveform can be applied adequately to the driving element by connecting the power sources to the driving element while switching the same, so that the fluid can be ejected accurately by the adequate control of the driving element. Also, since the driving voltage waveform is generated by switching the plurality of power sources, the electric power is not consumed by the amplifier element as described above. Therefore, the restraint of the power consumption is also achieved while enabling the accurate ejection of the fluid.

According to the fluid ejection device of the aspect of the invention, the timings to switch the power sources may be stored in coordination with the plurality of stored driving voltage waveforms. Then, when applying the driving voltage waveform, the power sources may be switched at the timings coordinated with the driving voltage waveform.

In this configuration, since the power sources can be switched at the adequate timings according to the selected driving voltage waveform, the driving voltage waveform can be generated accurately and hence can be applied to the driving element and, consequently, the fluid can be ejected accurately.

According to the fluid ejection device of the aspect of the invention, the element which can store the electric energy can be used as the driving element. For example, by using a capacitive element such as a piezoelectric element, the electric energy can be stored by holding a charge. Also, by using a conductive element such as a coil, the electric energy can be stored by a magnetic field generated in the interior of the element. Therefore, these elements can be used as the driving element. Then, by providing an electric storage unit connected in parallel to the power source, the electric energy of the driving element can be regenerated in the electric storage unit when the power source is connected to the driving element.

If the electric energy supplied to the driving element is regenerated in the electric storage unit, the regenerated electric energy can be supplied again to the driving element when connecting the power source again to the driving element, and hence the electric energy to be supplied newly from the power source may be reduced. Accordingly, the power consumption can be restrained.

The electric storage unit may be of any type as long as the electric energy can be stored therein. For example, an element for storing the electric energy by chemical means such as a secondary battery may be employed or, alternatively, an element for storing the electric energy by electromagnetic means such as a capacitor may be employed.

Also, when regenerating the electric energy of the driving element, limitation of interchange of the electric power between the electric storage unit and the power source may be provided. For example, a configuration in which the electric storage unit and the power source are connected with a diode so as to prevent the electric current from flowing from the electric storage unit side to the power source side is also applicable. In this configuration, the probability of flow of the electric energy regenerated from the driving element to the power source side can be avoided, so that regeneration of the electric energy in the electric storage unit is ensured. A configuration in which the switch is provided between the electric storage unit and the power source and the switch is disconnected when regenerating the electric energy is also applicable. In this configuration as well, the probability of the flow of the electric energy to the power source side can be avoided, so that reliable regeneration of the electric energy to restrain the power consumption is achieved.

BRIEF DESCRIPTION OF THE DRAWINGS

The invention will be described with reference to the accompanying drawings, wherein like numbers reference like elements.

DESCRIPTION OF EXEMPLARY EMBODIMENTS

In the following description, in order to clarify contents of the invention described above, an embodiment will be described in the following order.

A. Configuration of Device

B. Configuration of Driving Voltage Waveform Generating Circuit

C. Driving Voltage Waveform Applying Process

D. Modifications

D-1. First Modification

D-2. Second Modification

D-3. Third Modification

A. Configuration of Device

Figure 1:
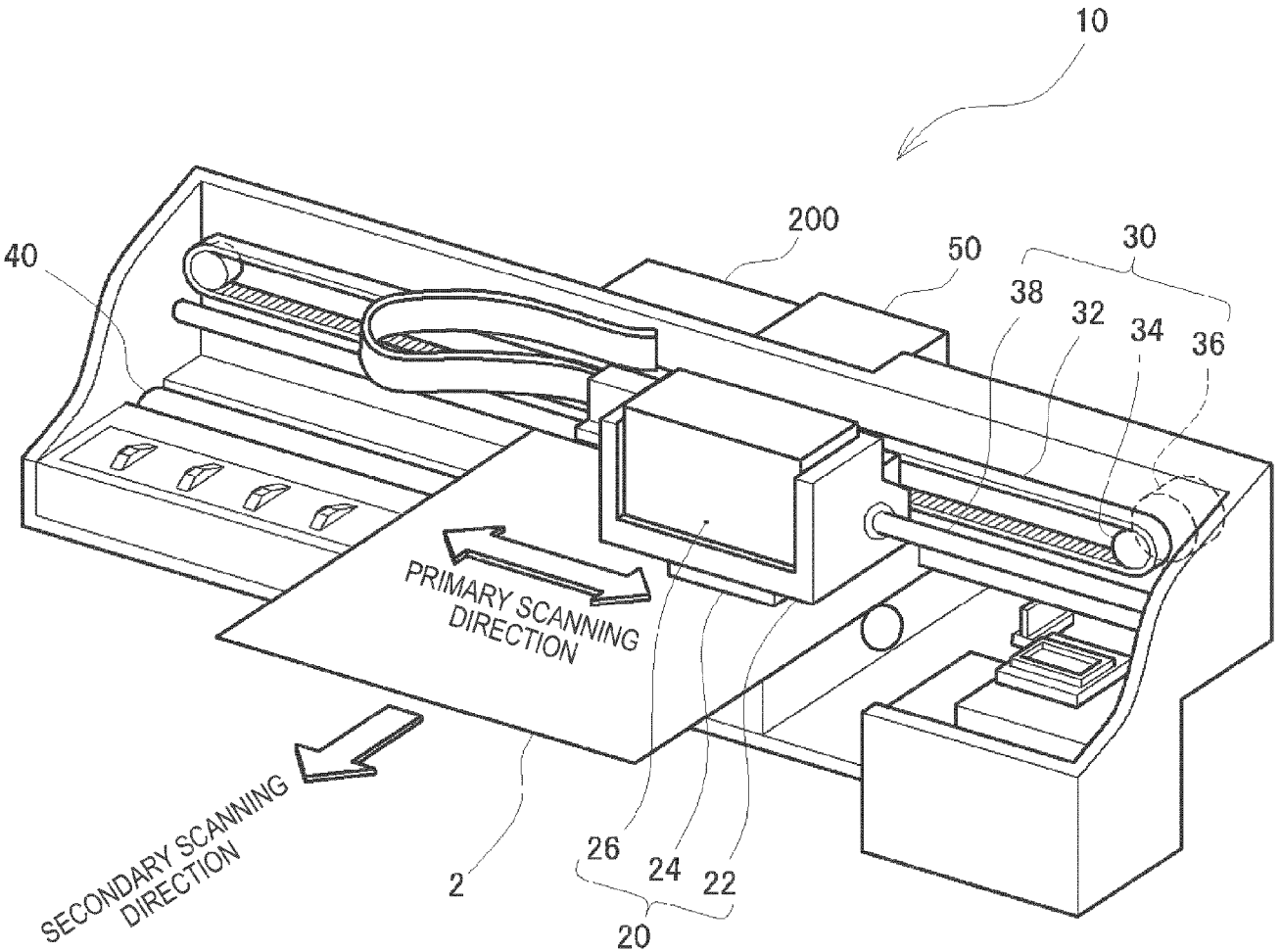
FIG. 1 is an explanatory drawing showing a rough configuration of a fluid ejection device according to an embodiment by using an inkjet printer as an example.

FIG. 1 is an explanatory drawing showing a rough configuration of a fluid ejection device according to an embodiment while using so-called an inkjet printer as an example. As illustrated, an inkjet printer 10 includes a carriage 20 configured to form ink dots on a printing medium 2 while reciprocating in a primary scanning direction, a drive mechanism 30 which causes the carriage 20 to reciprocate, and a platen roller 40 configured to feed the printing medium 2. The carriage 20 includes an ink cartridge 26 having ink stored therein, a carriage case 22 on which the ink cartridge 26 is mounted, and an ejection head 24 mounted on a bottom surface side (a side facing the printing medium 2) of the carriage case 22 for ejecting the ink, so as to be capable of introducing the ink in the ink cartridge 26 to the ejection head 24 and ejecting the ink of an accurate amount from the ejection head 24 to the printing medium 2.

The drive mechanism 30 which causes the carriage 20 to reciprocate includes a guide rail 38 provided so as to extend in the primary scanning direction, a timing belt 32 formed with a plurality of teeth inside thereof, a driving pulley 34 configured to mesh the teeth of the timing belt 32, and a step motor 36 configured to drive the driving pulley 34. Part of the timing belt 32 is fixed to the carriage case 22, and the carriage case 22 is moved with high degree of accuracy along the guide rail 38 by driving the timing belt 32.

The platen roller 40 configured to feed the printing medium 2 is driven by a drive motor or a gear mechanism, not shown, and is able to feed the printing medium 2 by a predetermined amount in a secondary scanning direction. These mechanisms are respectively controlled by a printer control circuit 50 mounted on the inkjet printer 10, and the inkjet printer 10 drives the ejection head 24 to cause the same to eject ink while feeding the printing medium 2 using these mechanisms, so that an image is printed on the printing medium 2.

Figure 2:
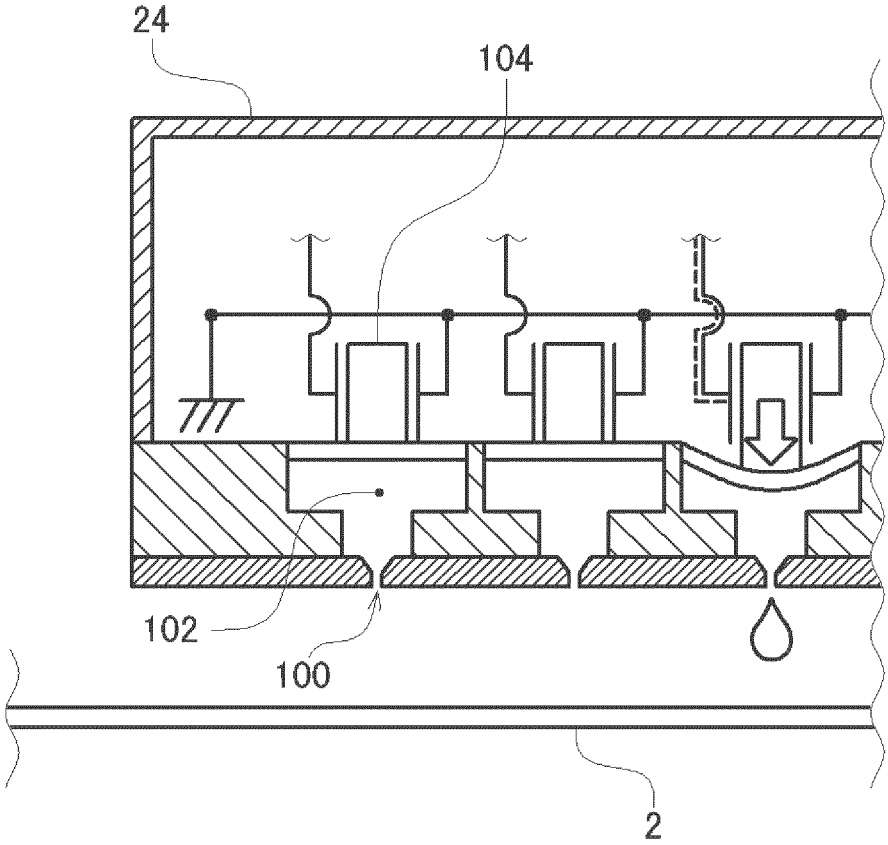
FIG. 2 is an explanatory drawing showing a mechanism in the interior of an ejection head in detail.

FIG. 2 is an explanatory drawing showing a mechanism in the interior of the ejection head 24 in detail. As illustrated, a bottom surface (a surface facing the printing medium 2) of the ejection head 24 is provided with a plurality of ejection ports 100 and is configured to be able to eject ink drops from the respective ejection ports 100. The respective ejection ports 100 are connected to the ink chambers 102, and the ink chambers 102 are filled with the ink supplied from the ink cartridge 26. Piezoelectric elements 104 are provided on the respective ink chambers 102 and, when a voltage is applied to the piezoelectric elements 104, the piezoelectric elements 104 are deformed and pressurize the ink chambers 102, so that the ink drops can be ejected from the ejection ports 100.

Since the piezoelectric elements 104 are deformed by different amounts depending on the applied voltage, the size of the ink drops to be ejected can be changed by adjusting the force or the timing to press the ink chambers 102 by controlling the voltage to be applied to the piezoelectric elements 104 adequately. Therefore, the inkjet printer 10 forms the voltage into a following waveform before applying the same to the piezoelectric elements 104.

Figure 3:
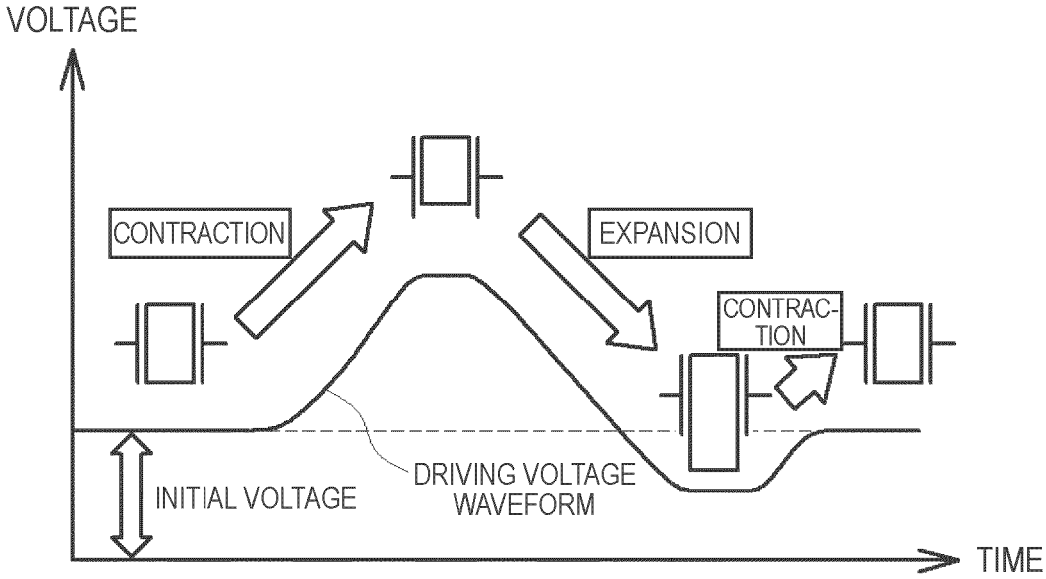
FIG. 3 is an explanatory drawing illustrating a voltage waveform (driving voltage waveform) to be applied to a piezoelectric element.

FIG. 3 is an explanatory drawing illustrating a voltage waveform (a driving voltage waveform) to be applied to the piezoelectric element. As illustrated, the driving voltage waveform has a trapezoidal shape in which the voltage is increased with elapse of time, and then is decreased to its original voltage. In the drawing, a state of expanding and contracting of the each piezoelectric element according to the driving voltage waveform as described above is also illustrated. As illustrated, when the voltage of the driving voltage waveform is increased, the piezoelectric element is gradually contracted correspondingly. At this time, since an ink chamber is expanded as if it is pulled by the piezoelectric element, the ink is supplied from the ink cartridge into the ink chamber.

When the voltage is increased and reaches its peak and then the voltage is decreased, the piezoelectric element is expanded, so that the ink chamber is compressed to eject the ink from the ejection port. At this time, the driving voltage waveform is adapted to be dropped to a voltage lower than its original voltage (a voltage indicated as "initial voltage" in the drawing), so that the piezoelectric element is expanded to an extent more than the initial state, thereby being able to push the ink out sufficiently. Subsequently, the driving voltage waveform is returned back to the initial voltage, and the piezoelectric element is returned to the initial state correspondingly to be ready for the next action.

In this manner, since the piezoelectric element is expanded and contracted according to the driving voltage waveform, the size of the ink drops to be ejected from the ejection ports 100 can be controlled by applying the adequate driving voltage waveform to the piezoelectric elements. Accordingly, the inkjet printer 10 in this embodiment includes a driving voltage waveform generating circuit 200 configured to generate the driving voltage waveform as such adequately.

B. Configuration of Driving Voltage Waveform Generating Circuit

Figure 4:
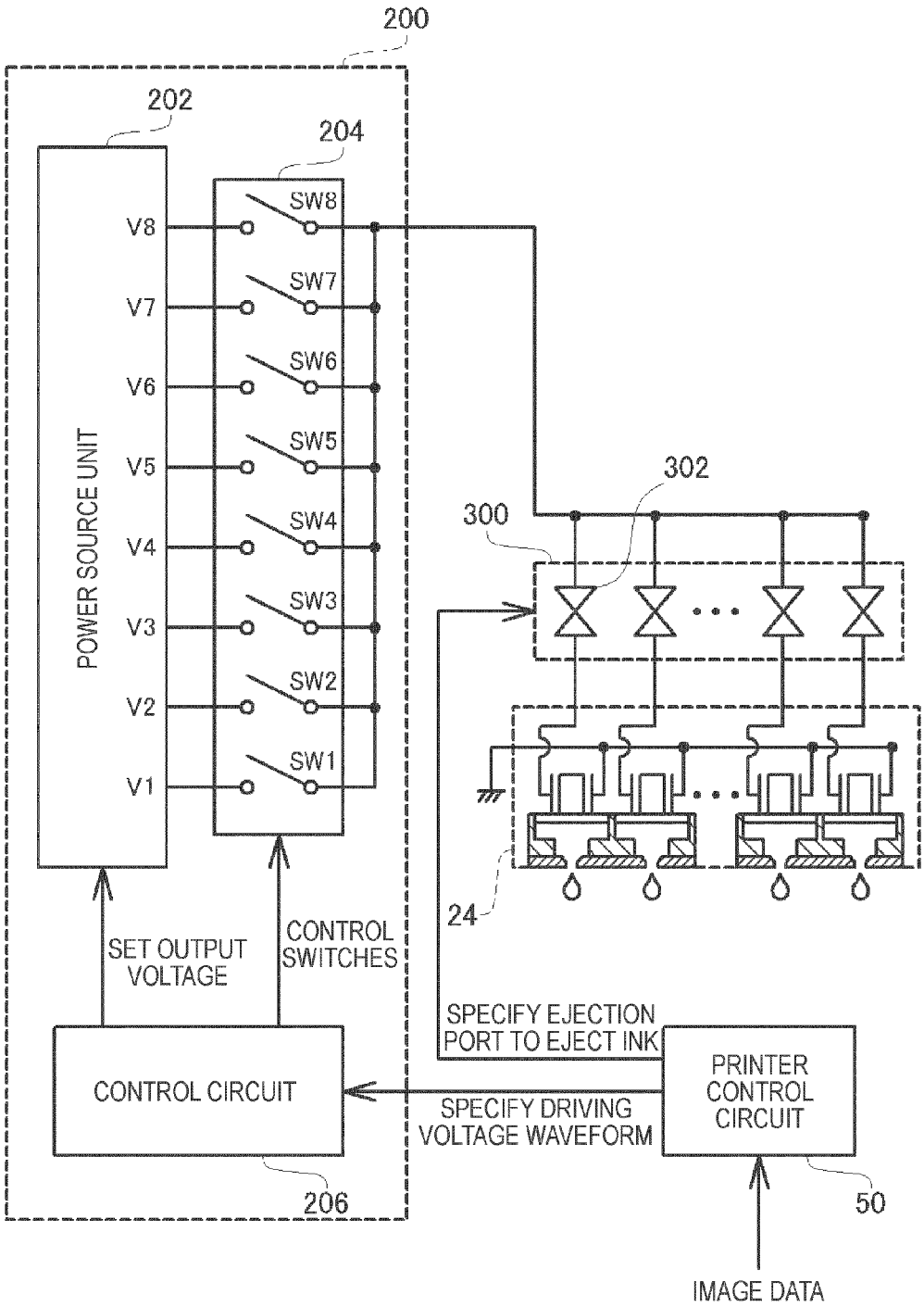
FIG. 4 is an explanatory drawing illustrating a circuit configuration of a driving voltage waveform generating circuit and the periphery thereof.

FIG. 4 is an explanatory drawing illustrating a circuit configuration of a driving voltage waveform generating circuit and the periphery thereof. As illustrated, the driving voltage waveform generating circuit 200 includes a power source unit 202, a switch unit 204, and a control circuit 206 configured to control the power source unit 202 and the switch unit 204. The power source unit 202 is a circuit module including eight constant voltage circuits, and is able to output voltages from eight output terminals (terminals indicated as V1 to V8 in the drawing) corresponding to the eight constant voltage circuits respectively. Also, the voltages outputted from the respective output terminals can be set individually for the respective output terminals, and the respective voltages are set by the control circuit 206 connected to the power source unit 202.

The eight outputs from the power source unit 202 are connected to the switch unit 204, so that the voltage waveform can be generated by switching the eight outputs by operating respective switches SW1 to SW8 of the switch unit 204. For example, the output voltage of the power source unit 202 is set to increase gradually from the output terminal V1 toward the output terminal V8 and then only the switch SW1 is turned ON and other switches are turned OFF. In this state, only the output terminal V1 is connected, and hence the voltage of the output terminal V1 is outputted from the driving voltage waveform generating circuit 200.

From this state, the switch SW2 is now turned ON and then other switches are turned OFF. Accordingly, the voltage of the output terminal V2 is outputted. In the same manner, when the switch SW3 is turned ON and other switches are turned OFF, the voltage of the output terminal V3 is outputted. In this manner, by turning the switches from the switch SW1 to the switch SW8 ON in sequence, the voltage waveform which is increased from the voltage of the output terminal V1 to the voltage of the output terminal V8 can be outputted.

The voltage waveform outputted from the driving voltage waveform generating circuit 200 is guided to a gate unit 300 as illustrated. The gate unit 300 has a configuration in which a plurality of gate elements 302 are connected in parallel, and the piezoelectric elements 104 are connected respectively to positions ahead of the gate elements 302. The gate elements 302 can be brought into a conduction state and a clear state individually, and by bringing only the gate element 302 at the ejection port which is wanted to eject the ink into the conduction state, the voltage is applied only to the corresponding piezoelectric element 104, so that the ink drops can be ejected from the wanted ejection port.

The driving voltage waveform generating circuit 200 and the gate unit 300 are connected respectively to the printer control circuit 50, and is adapted to be driven according to a command from the printer control circuit 50. With the respective circuit configuration as described above, the printer control circuit 50 ejects the ink drops as follows. First of all, on the basis of an image data to be printed, the ejection ports for ejecting the ink drops and the size of the ink drops to be ejected are determined.

Subsequently, on the basis of the size of the ink drops to be ejected, the voltage waveform (the driving voltage waveform) for ejecting the ink drops having the corresponding size is determined. Then, the command is sent to the gate unit 300 to bring the gate elements 302 corresponding to the ejection ports into the conduction state and the command is sent to the driving voltage waveform generating circuit 200 to generate the determined driving voltage waveform. In response to it, the driving voltage waveform generating circuit 200 generates the driving voltage waveform by switching the switch unit 204 in sequence, and applies the driving voltage waveform to the piezoelectric elements 104 at the ejection ports specified via the gate element 302. Accordingly, the ink drops of the intended size are ejected from the intended ejection ports.

In this manner, the inkjet printer 10 in this embodiment ejects the ink drops from the ejection ports by generating the voltage waveform by the driving voltage waveform generating circuit 200, and applying the voltage waveform to the piezoelectric elements via the gate unit 300. Here, as described above, the driving voltage waveform generating circuit 200 generates the driving voltage waveform by operating the respective switches of the switch unit 204.

When an amplifier element such as a transistor is used for generating the driving voltage waveform, as described above, the dissipation in the amplifier element (such as a collector dissipation) occurs, and hence a power consumption may be increased, or upsizing of the device due to the necessity of the heat discharging panel for releasing heat generated by the dissipation. In contrast, according to the driving voltage waveform generating circuit 200 in this embodiment, since the driving voltage waveform is generated by switching the plurality of power sources with the switch, the dissipation in the amplifier element does not occur, and hence power saving is possible. Also, since the heat discharging apparatus such as the heat discharging panel can be omitted, downsizing of the apparatus is also possible.

Since the voltage waveform is generated by switching the power sources as a matter of fact, the generated driving voltage waveform assumes the waveform in which the voltage is changed in a staircase pattern, so that generation of an accurate waveform may be difficult. As described above, since the inkjet printer 10 controls the size of the ink drops to be ejected by driving the piezoelectric elements according to the driving voltage waveform, accurate control of the size of the ink drops cannot be achieved easily unless the accurate waveform can be generated. Therefore, in this embodiment, the driving voltage waveform is generated while performing the following control process for enabling the accurate control of the size of the ink drops while realizing power saving or downsizing by the driving voltage waveform generating circuit 200 as described above.

C. Driving Voltage Waveform Applying Process

Figure 5:
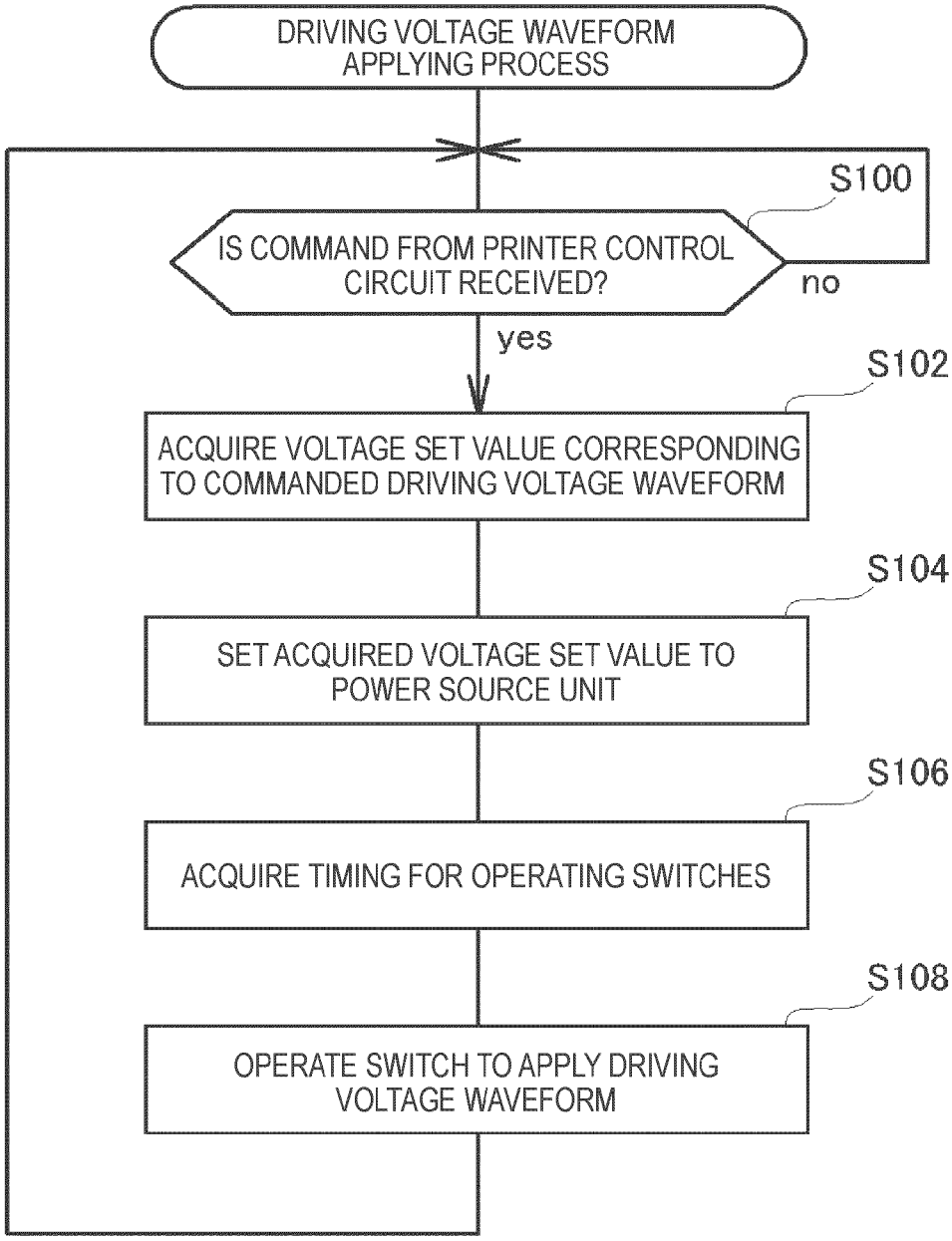
FIG. 5 is a flowchart showing a flow of a driving voltage waveform applying process.

FIG. 5 is a flowchart showing a flow of the driving voltage waveform applying process in this embodiment. The process as described above is a process for generating the driving voltage waveform according to the command from the printer control circuit 50, and is a process started immediately by the control circuit 206 when the inkjet printer 10 is turned ON and the respective devices are activated. Such the process may be performed by providing a CPU such as a microcomputer chip in the control circuit 206 and then driving software, or may be performed using a specific hardware such as, so-called, an ASIC.

When the process is started, whether or not the command from the printer control circuit 50 is received is determined first as illustrated (Step S100). Since the printer control circuit 50 specifies the driving voltage waveform to be generated for the driving voltage waveform generating circuit 200 as described above (see FIG. 4), whether or not this command is received is determined. The printer control circuit 50 is able to specify the driving voltage waveform in various methods.

For example, a method of storing a plurality of types of driving voltage waveforms in the control circuit 206 in advance and specifying one of them by the printer control circuit 50 is also applicable. Alternatively, the driving voltage waveform may be sent to the control circuit 206 as an analog signal. In this embodiment, for the simplicity, the description is given assuming that two types of driving voltage waveforms including a driving voltage waveform for large dots for ejecting large ink drops and a driving voltage waveform for small dots for ejecting small ink drops are stored in the control circuit 206 in advance, and the printer control circuit 50 specifies one of these waveforms.

When the command from the printer control circuit 50 is not received (No in Step S100 in FIG. 5), the procedure goes back to Step S100 again and determination in Step S100 is repeated to wait until the command is received. When the command from the printer control circuit 50 is received (yes in Step S100), the voltage is set to the power source unit 202 to cause the same to generate the voltage in order to generate the driving voltage waveform. Here, in the "driving voltage waveform applying process" in this embodiment, the process to change the voltage of the power source unit 202 according to the driving voltage waveform specified by the printer control circuit 50 is performed, whereby the size of the ink drops to be ejected can be controlled adequately. This point will be described later in detail. In this embodiment, in order to change the voltage of the power source unit 202 according to the specified driving voltage waveform, a process to acquire a voltage set value corresponding to the specified driving voltage waveform is performed (Step S102).

Figures 6A, 6B:
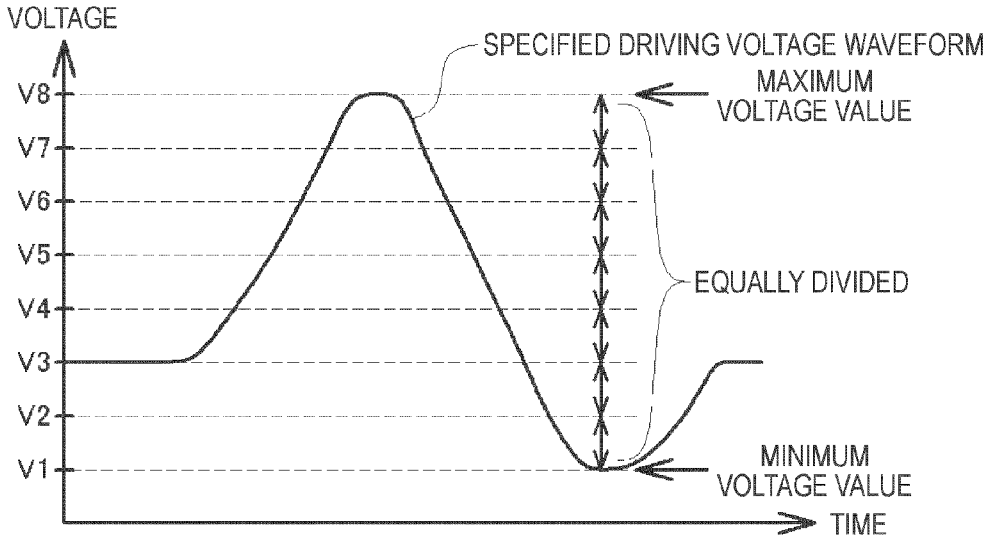
FIG. 6A and FIG. 6B are explanatory drawings illustrating a method of acquiring a voltage set value of a power source unit corresponding to the specified driving voltage waveform.

FIG. 6A and FIG. 6B are explanatory drawings illustrating a method of acquiring the voltage set value of a power source unit corresponding to the specified driving voltage waveform. FIG. 6A shows a table in which the voltage set values of the power source unit are coordinated with the two types of driving voltage waveforms (waveform for large dots and waveform for small dots) specified by the printer control circuit 50, respectively. Since the printer control circuit 50 specifies either one of the driving voltage waveform for large dots and the driving voltage waveform for small dots, by storing the table as described above in advance, the voltage set value of the power source unit corresponding to the specified voltage waveform can be acquired by referring to the table. Such the corresponding table may be stored on a ROM provided in the control circuit 206, or may be acquired from the printer control circuit 50.

In contrast, the voltage set value of the power source unit can also be acquired by analyzing the specified driving voltage waveform instead of referring to a coordinate table. For example, as shown in FIG. 6B, the driving voltage waveform is received from the printer control circuit 50 as an analog signal, a maximum voltage and a minimum voltage of the received driving voltage waveform are checked, and the respective voltages from V1 to V8 of the power source unit are determined to divide the voltage therebetween equally for the respective output terminals. Accordingly, since a reference table does not have to be stored in advance, a storage capacity can be saved. In contrast, if the reference table is stored in advance, since analysis of the waveform is not necessary, quick acquisition of the voltage set value is achieved.

When the voltage set value corresponding to the specified driving voltage waveform is acquired, the acquired voltage set value is then set to the power source unit 202 (Step S104 in FIG. 5). Accordingly, since the voltages are outputted from the respective output terminals of the power source unit 202 (see FIG. 4), the voltage waveform can be generated by switching the respective switches of the switch unit 204 in sequence as described above.

Here, when switching the respective switches of the switch unit 204, the switches may be switched in sequence at a predetermined time interval (for example, an interval of 1 micro second). However, by adjusting the timing to switch the switches adequately, the voltage waveforms can be generated further accurately. Accordingly, in this embodiment, after having set the voltage of the power source unit 202, a process to acquire data relating to the timing of operation of the switch (switch timing data) is preformed (Step S106 in FIG. 5).

Figure 7:
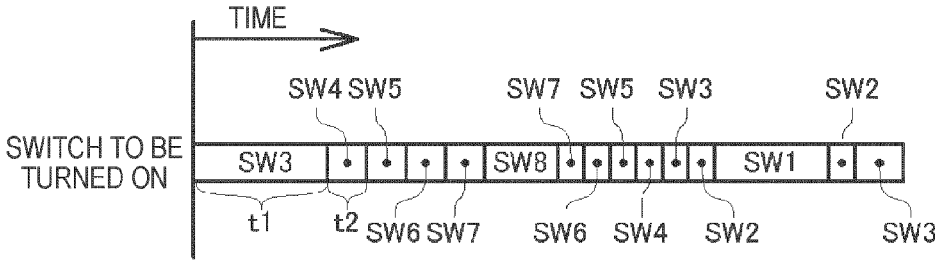
FIG. 7 is an explanatory drawing illustrating switch timing data.

FIG. 7 is an explanatory drawing illustrating the switch timing data. As illustrated, the switch timing data is data in which the switch to turn ON, the timing to turn ON, and a time interval to keep the switch turned ON are described. For example, in the example shown in FIG. 7, when the operation of the switch unit 204 is started, the switch SW3 is turned ON first. Then, when a specified time (a time indicated as "t1" in the drawing) is elapsed, then the switch SW4 specified as the next step is turned ON and other switches are turned OFF.

Subsequently, when a specified time (a time indicated as "t2" in the drawing) is elapsed, then the switch SW5 specified as the next step is turned ON and other switches are turned OFF. Subsequently, in the same manner, the specified switches may be operated along the elapse of time. In this manner, since the switches to be operated along the elapse of time are specified, the respective switches can be operated according to switch timing data if the switch timing data is acquired.

The switch timing data as described above may be the one stored in the ROM of the control circuit 206 in advance and acquired by reading out from the ROM, or the one acquired from the printer control circuit 50. Also, a configuration such that a plurality of types of switch timing data are stored and the printer control circuit 50 specifies switch timing data to be used from among them may also be applicable. Accordingly, since the further adequate switch timing data can be specified according to the driving voltage waveform to be generated, the driving voltage waveform can be generated further accurately by switching the switches at an adequate timing. When the switch timing data is acquired in this manner, the driving voltage waveform is applied to the piezoelectric elements by actually operating the switch (Step S108 in FIG. 5).

Figure 8:
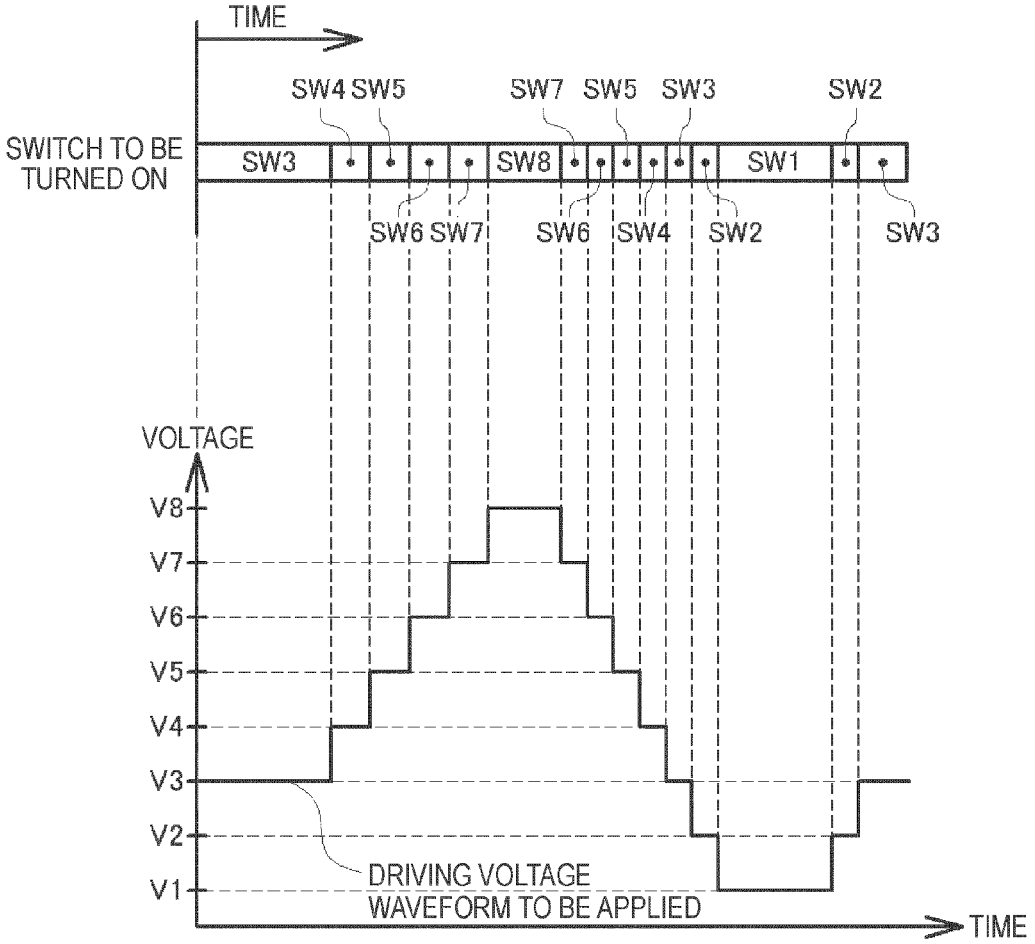
FIG. 8 is an explanatory drawing showing a state in which the driving voltage waveform is applied to the piezoelectric element by operating a switch unit.

FIG. 8 is an explanatory drawing showing a state in which the driving voltage waveform is applied to the piezoelectric element by operating the switch unit 204. As described above, since the switch to be turned ON is specified in the switch timing data, the specified switch is turned ON according to the switch timing data, and other switches are turned OFF. Since the switch SW3 is specified to be firstly turned ON in the illustrated example, the switch SW3 is turned ON and other switches are turned OFF. At this time, since the switch SW3 is connected to the output terminal V3 of the power source unit 202 (see FIG. 4), the voltage of the output terminal V3 (the voltage indicated as "V3" in the drawing) is outputted and applied to the piezoelectric elements as shown in a graph in FIG. 8.

When the time has elapsed and a timing to switch the switches has come after having applied the voltage in this manner, the switches are switched again according to the switch timing data. Since the switch SW4 is specified to be turned ON next in the illustrated example, the switch SW4 is turned ON and other switches are turned OFF. Accordingly, a voltage equal to the voltage of the output terminal V4 (the voltage indicated as "V4" in the drawing) is applied to the piezoelectric elements as illustrated. In this manner, by operating the switches in sequence, the driving voltage waveform can be applied to the piezoelectric element while changing the output voltage with the elapse of time as shown in the graph in the drawing.

In this manner, in the "driving voltage waveform applying process" in this embodiment, when the driving voltage waveform is specified by the printer control circuit 50, the voltage of the power source unit 202 is set according to the specification (see Step S102 and Step S104 in FIG. 5), and then the switch unit 204 is operated to apply the driving voltage waveform. Accordingly, in the driving voltage waveform applying process in this embodiment, the ink drops of adequate size can be ejected. This point will be described below.

Figure 9A:
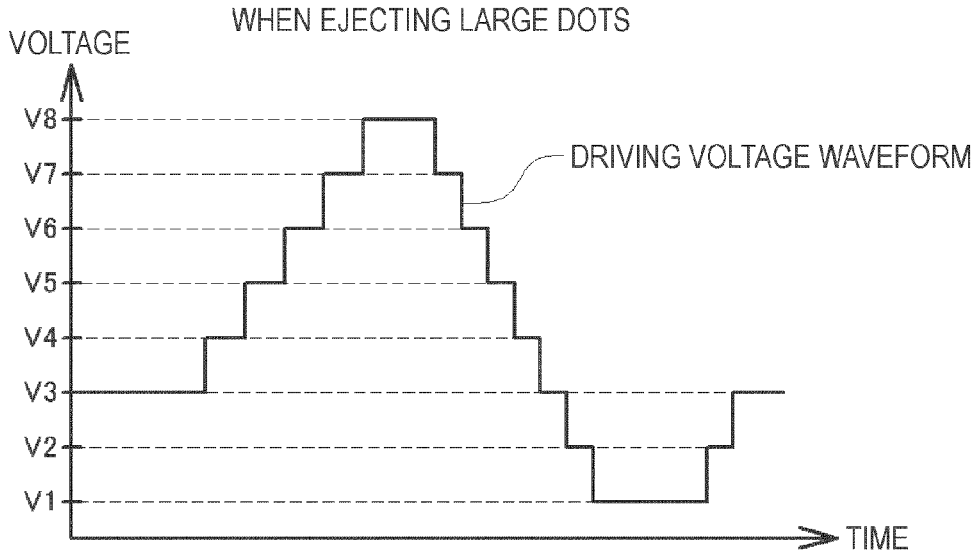
FIG. 9A and FIG. 9B are explanatory drawings illustrating the driving voltage waveforms to be applied to the piezoelectric element by the driving voltage waveform applying process in the embodiment.
Figure 9B:
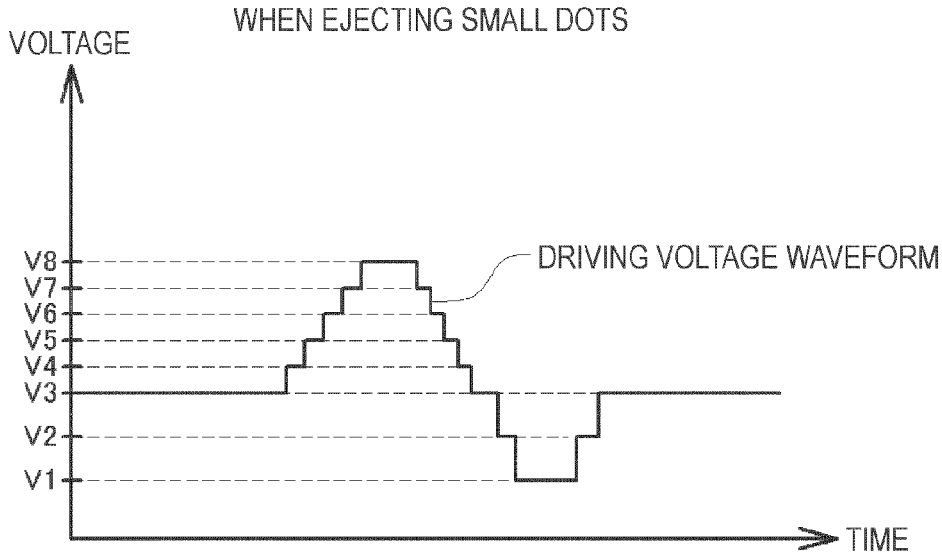

FIG. 9A and FIG. 9B are explanatory drawings illustrating driving voltage waveforms to be applied to the piezoelectric element by the driving voltage waveform applying process in this embodiment. In FIG. 9A, the driving voltage waveform to be applied when the large dots are ejected is illustrated. When ejecting the large dots, since a larger amount of ink should be pushed out from the ejection ports, the piezoelectric elements are needed to be expanded and contracted by a large amount, so that the driving voltage waveform having a large amplitude is needed to be applied to the piezoelectric elements. Accordingly, when generating such the driving voltage waveform, the voltages from "V1" to "V8" are set to have a large interval among the output voltages (the voltages indicated as "V1" to "V8" in the drawing) of the respective output terminals of the power source unit 202 as illustrated. Accordingly, the driving voltage waveform having the large amplitude is generated to drive the piezoelectric elements to a large magnitude, so that the large dots can be ejected adequately.

In contrast, in FIG. 9B, the driving voltage waveform to be applied when the small dots are ejected is illustrated. When ejecting the small dots, the amplitude of the driving voltage waveform may be small, but further accurate control of the driving voltage waveform is needed because a small amount of ink are ejected. Therefore, when the voltage is changed in a staircase pattern by a large amount, the ink drops having an accurate size may not be ejected. Accordingly, when ejecting the small dots, the voltages of the respective output terminals of the power source unit 202 are set to have a small interval as illustrated. Accordingly, since the voltage can be changed little by little, the abrupt change of the voltage is eliminated, and the ink drops of an accurate size can be ejected.

In the example shown in FIG. 9B, the voltages of the power source unit are set so that the difference in voltage becomes smaller at a voltage higher than the voltage in the initial state (the voltage indicated as "V3" in the drawing). As it is known that the size of the ink drops can be controlled more accurately by generating the waveform of the part as described above when ejecting small ink drops on the basis of the experience, the ink drops having the more accurate size can be ejected with the configuration as described above.

In this manner, in the driving voltage waveform applying process in this embodiment, the output voltages of the respective terminals of the power source unit 202 are differentiated according to the driving voltage waveform to be generated. Therefore, the voltages suitable for generating the driving voltage waveform can be outputted from the power source unit 202. As a matter of course, when setting the voltages of the power source unit 202, it is also possible to set an important part in the driving voltage waveform to be divided more minutely as illustrated in FIG. 9B as well as setting the voltage according to the amplitude of the driving voltage waveform. In this manner, in this embodiment, since the voltage set value of the power source unit 202 can be changed according to the driving voltage waveform to be generated, voltages adequate for generating the driving voltage waveform can be outputted from the power source unit 202 and, consequently, the size of the ink drops to be ejected can be controlled by generating an adequate driving voltage waveform.

When the driving voltage waveform is applied to the piezoelectric elements as described above (Step S108 in FIG. 5), the procedure goes back to Step S100 to wait until the next command is issued from the printer control circuit 50 as shown in FIG. 5. Then, when the command is issued from the printer control circuit 50 again, the voltage of the power source unit 202 is reset again according to the driving voltage waveform to be generated (Step S102, Step S104). Accordingly, since the adequate voltages can be outputted from the power source unit 202 according to the specified driving voltage waveform, the adequate driving voltage waveform can be generated and applied to the piezoelectric elements as described above. Consequently, the ink drops can be ejected while controlling their size adequately, and hence a high-quality image can be printed on the printing medium 2.

In the driving voltage waveform applying process in this embodiment, further restraint of the power consumption is achieved in addition to the accurate control of the size of the ink drops. In other words, at the timing when the voltage is changed in a staircase pattern in the driving voltage waveform (the timing of switching the switches of the switch unit), an electric current flows in association with the change of the voltage, and hence heat may be generated at wirings or at the respective switches of the switch unit 204 in the driving voltage waveform generating circuit 200 thereby consuming the electric power.

In the driving voltage waveform applying process in this embodiment, since the voltage of the power source unit can be reset according to the driving voltage waveform to be generated, the step difference of the voltage can be restrained to a small magnitude. Therefore, by restraining the flowing electric current by reducing the voltage change, the power consumption can also be restrained by restraining the heat generation. In this configuration, since the anti-heat measure such as the heat discharging panel can be simplified, further downsizing of the device is achieved. In addition, improvement of the lifetime of the piezoelectric elements or the switch unit is also achieved.

Since the step difference of the voltage can be reduced, the power consumption can further be restrained by restraining the electric power which passes through the piezoelectric elements. In other words, since the piezoelectric element is a capacitive load, the electric characteristics are substantially the same as a capacitor, and hence the piezoelectric element has a characteristic to allow easy passage of a high-frequency electric current like the capacitor. Here, in the portion of the driving voltage waveform where the voltage is changed in a staircase pattern, a high-frequency electric current is generated because the voltage is abruptly changed in a short time. Therefore, it seems that the high-frequency electric current as described above passes through the piezoelectric elements, and hence consumes the electric power. In this embodiment, since the step difference of the voltage of the portion as described above is achieved, reduction of the high-frequency current can be reduced and, consequently, the power consumption can be restrained more by reducing the electric current passing through the piezoelectric elements.

Furthermore, in this embodiment, since the voltage waveform can be generated adequately even though the number of the electric source is limited, it is not necessary to prepare a number of electric sources. Therefore, downsizing of the device is also achieved by simplifying the circuit configuration.

D. Modifications

There are several conceivable modifications of the embodiment described above. These modifications are described briefly below.

D-1. First Modification

In the description of the embodiment described above, the voltage of the power source unit is set when outputting the driving voltage waveform for ejecting the ink drops. However, the driving voltage waveform generating circuit in this embodiment can be applied effectively to a case other than generating the driving voltage waveform. For example, in the inkjet printer 10 in the embodiment described above, the constant initial voltage is applied to the piezoelectric elements also while the ink drops are not ejected (see FIG. 3). Therefore, in the driving voltage waveform generating circuit in this embodiment, the following advantages are achieved by setting the voltage of the power source unit when applying the initial voltage.

Figure 10:
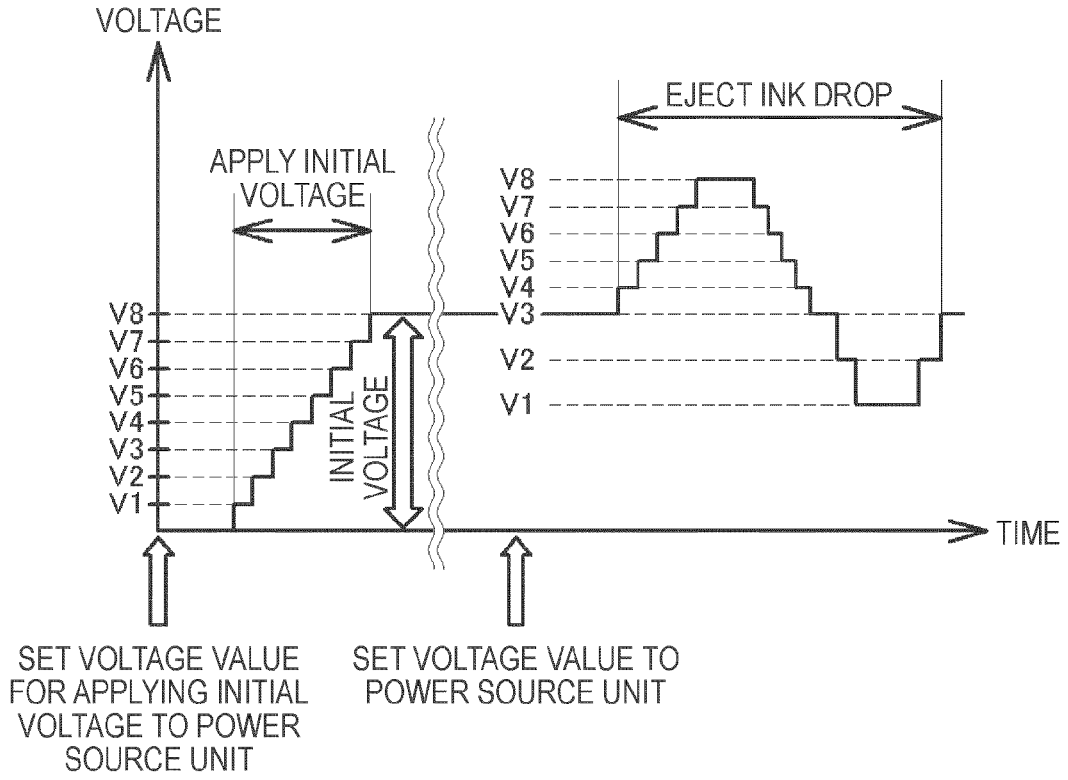
FIG. 10 is an explanatory drawing showing a state in which the voltage of the power source unit is set when applying an initial voltage to the piezoelectric element.

FIG. 10 is an explanatory drawing showing a state in which the voltage of the power source unit is set when applying the initial voltage to the piezoelectric element. As illustrated, when applying the initial voltage from a state in which the voltage is not applied at all, a voltage for the application of the initial voltage is set to the power source unit. Here, the voltage set value for the application of the initial voltage is set so as to divided the initial voltage equally among the eight output terminals from V1 to V8. Therefore, the initial voltage can be applied to the piezoelectric elements while raising the voltage little by little. As described above, when the voltage to be applied to the piezoelectric elements is changed significantly, the electric power is consumed from such reasons that a large electric current flows and hence heat is generated, or that the high-frequency electric current flows out through the piezoelectric elements. However, by raising the voltage little by little in this manner, the large electric current does not flow, and hence the power consumption at the time of application of the initial voltage can be restrained.

Also, a configuration in which the voltage of the power source unit is changed when generating so-called fine vibrations in the piezoelectric elements as well as the time of application of the initial voltage is also applicable. In other words, since the ejection port 100 of the inkjet printer 10 is exposed to the outside air also while the ink drops are not ejected (see FIG. 2), the ink in the ink chamber may be dried and increased in viscosity in the interim near the ejection ports. Therefore, by applying the minute driving voltage waveform to the piezoelectric elements while the ink drops are not ejected, the ink in the ink chamber is finely vibrated, so that the increase in viscosity can be prevented. In this case as well, by changing the voltage of the power source unit when applying the driving voltage waveform for the fine vibrations, the driving voltage waveform for the fine vibrations can be generated accurately, so that the increase in viscosity of the ink can be prevented adequately.

When applying the initial voltage, or after the generation of the fine vibrations, the voltage of the power source unit may be reset according to the driving voltage waveform to be generated at the timing of ejecting the ink drops (see FIG. 10) as described above. Consequently, since the adequate voltage is always set to the power source unit, application of the voltage or the generation of the driving voltage waveform can be performed adequately.

D-2. Second Modification

In the description of the embodiment described above, the voltage of the power source unit is changed according to the driving voltage waveform to be generated. However, the voltage may be changed for correcting the individual specificity among the piezoelectric elements or the ejection nozzles instead of changing according to the driving voltage waveform. For example, from the reasons such as variations in quality at the time of manufacture, the piezoelectric elements may include those being deformed by an extent smaller than other piezoelectric elements when the voltage is applied. In such a case, by changing the voltage of the power source unit and applying the larger voltage, the individual difference can be corrected to cause the piezoelectric elements to be deformed by an accurate extent and, consequently, the ink drops can be ejected accurately.

D-3. Third Modification

In the driving voltage waveform generating circuit according to this embodiment, the power consumption can further be restrained by connecting the capacitors to the respective output terminals of the power source unit.

Figure 11:
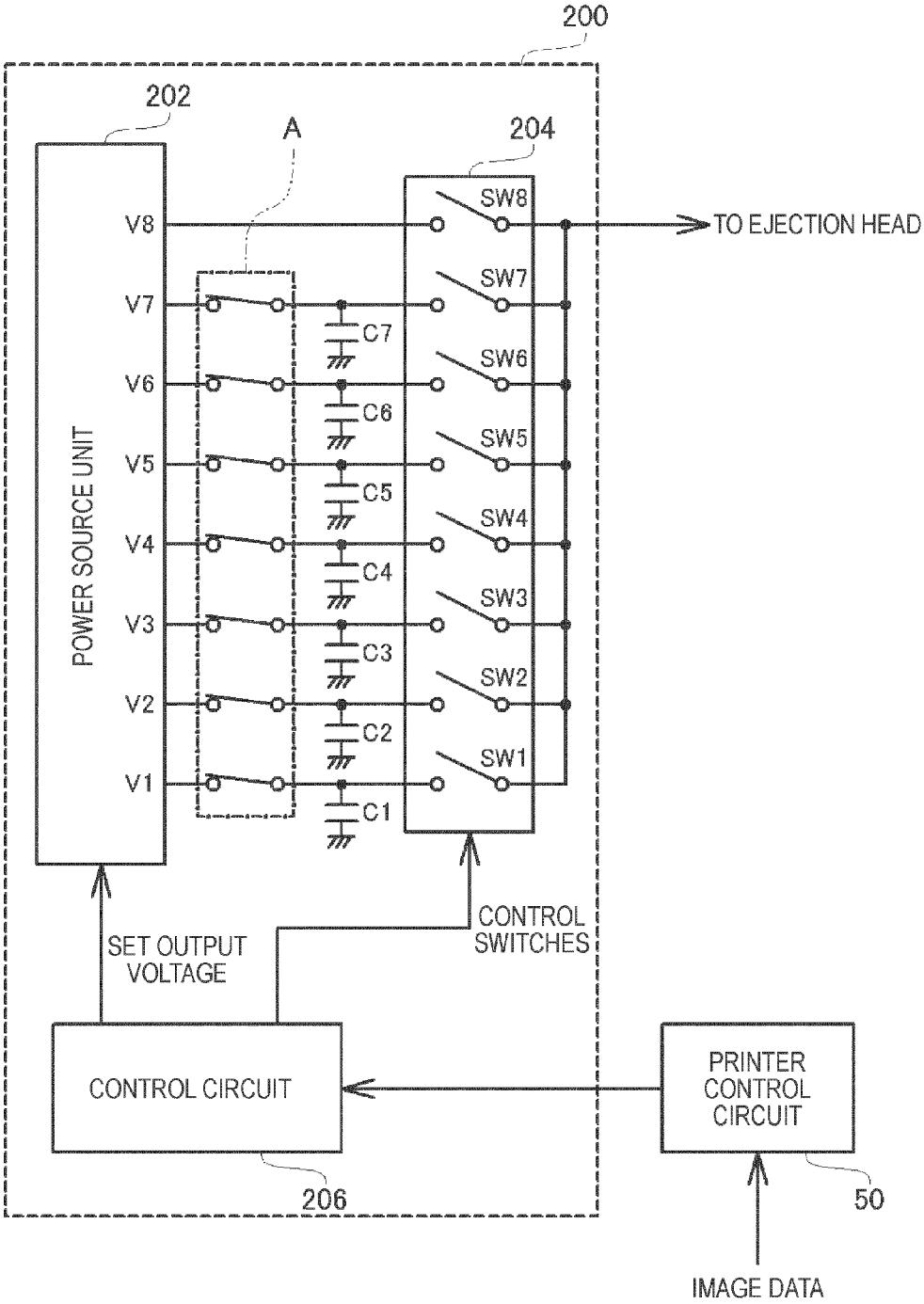
FIG. 11 is an explanatory drawing showing the driving voltage waveform generating circuit according to a modification in which a capacitor is connected to an output terminal of the power source unit.

FIG. 11 is an explanatory drawing showing the driving voltage waveform generating circuit according to the modification in which the capacitor is connected to the output terminal of the power source unit. As illustrated, capacitors C1 to C7 are connected respectively to the output terminals of the power source unit 202. Also, switches are provided between the capacitors and the power source unit 202 (switch indicated as "A" in the drawing), so that the power source and the capacitors can be disconnected. With the circuit configuration as described above, the charge applied to the piezoelectric elements can be regenerated by the capacitor and, consequently, the power consumption can further be restrained. This point will be described with reference to FIG. 12A to FIG. 12C.

Figure 12A:
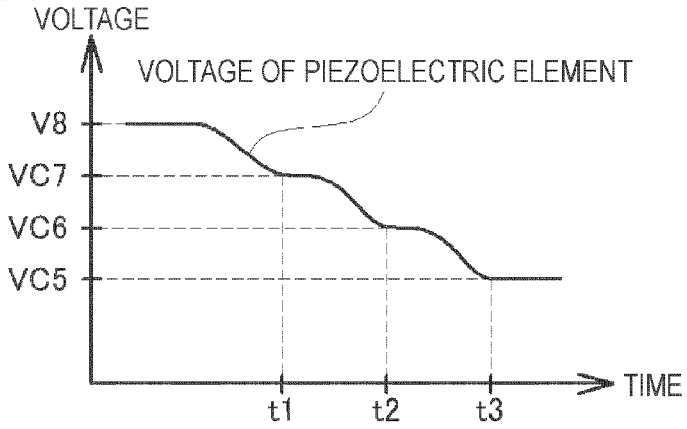
FIG. 12A to FIG. 12C are explanatory drawings illustrating a state in which a charge applied to the piezoelectric element using the driving voltage waveform generating circuit according to the modification is regenerated.
Figure 12B:
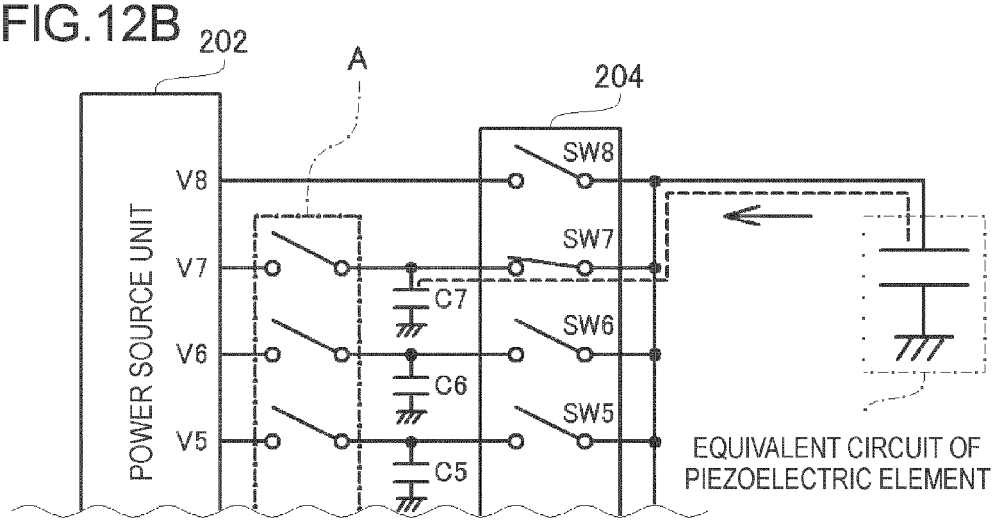
Figure 12C:
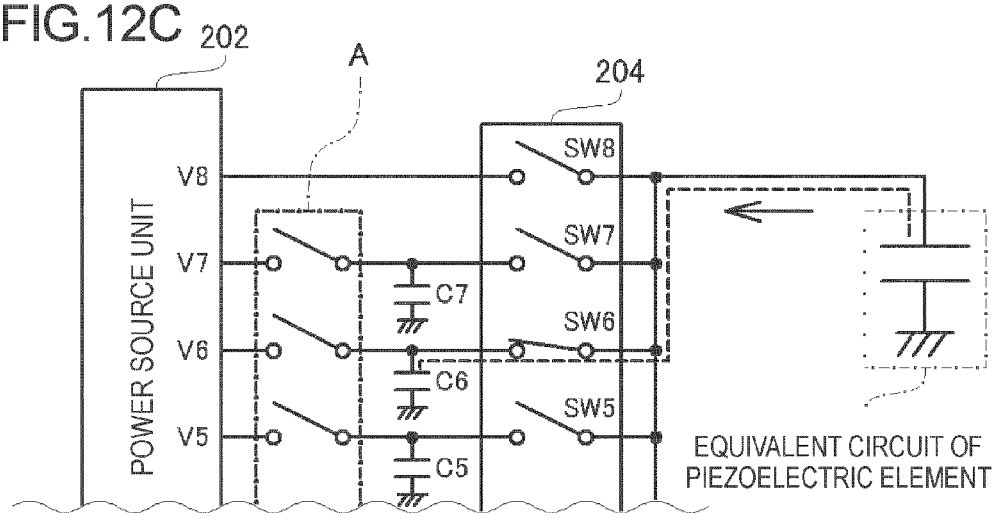

FIG. 12A to FIG. 12C are explanatory drawings illustrating a state in which the charge applied to the piezoelectric element using the driving voltage waveform generating circuit according to the modification is regenerated. In FIG. 12A, a state in which the voltage of the piezoelectric element is changed in association with the regeneration of the charge is shown. As described above, the voltage is applied to the piezoelectric elements by connecting the output terminals V1 to V8 of the power source unit 202 in sequence, and the voltage of the piezoelectric elements is raised to the same voltage as the voltage of the output terminal V8 (the voltage indicated as "V8" in the drawing). Here, since the piezoelectric element is the capacitive load, in the state in which the voltage is applied, the piezoelectric element assumes the state of having the charge stored therein.

In the driving voltage waveform generating circuit in the modification, the charge stored in the piezoelectric element is regenerated in the capacitor in the following manner. First of all, as illustrated in FIG. 12B, the switch unit 204 is operated to connect the capacitor C7 and the piezoelectric element. Since the voltage of the piezoelectric element is higher than the voltage of the capacitor C7 (the voltage substantially the same as the terminal V7 of the power source unit), the charge flows from the piezoelectric element toward the capacitor C7. Accordingly, the charge of the piezoelectric element can be regenerated in the capacitor C7.

When the charge flows to the capacitor C7, as illustrated in FIG. 12A, the voltage of the piezoelectric element is gradually lowered, and finally reaches the same voltage as the voltage of the capacitor C7 (the voltage indicated as "VC7" in the drawing). When this state is assumed, the charge does not flow out from the piezoelectric element. Then, as illustrated in FIG. 12C, the piezoelectric element is connected to the capacitor C6. The voltage of the capacitor C6 is substantially the same voltage as the terminal V6 of the power source unit 202 (see FIG. 11), and is lower than the voltage (VC7) of the piezoelectric element, the charge can then be regenerated from the piezoelectric element to the capacitor C6.

When the charge is regenerated in the capacitor C6, the voltage of the piezoelectric element is lowered, and finally reaches the same voltage as the capacitor C6 (the timing indicated as "t2" in the drawing). Therefore, the piezoelectric element may be connected to the capacitor C5. By repeating the operation as described above, the charge of the piezoelectric element can be regenerated in the capacitors C1 to C7.

In this manner, the charge regenerated in the capacitor can be used again when applying the voltage to the piezoelectric element. In other words, since the capacitors C1 to C7 are connected in parallel to the respective output terminals of the power source unit (see FIG. 11), the electric power can be supplied to the piezoelectric element not only from the power source unit, but also from the respective capacitors by operating the switch unit 204. In this manner, in the driving voltage waveform generating circuit in the modification, the charge supplied to the piezoelectric element can be regenerated in the capacitor, and then the regenerated charge can be supplied again to the piezoelectric element. Therefore, since all the charges do not have to be supplied from the power source unit every time when the voltage is applied to the piezoelectric elements, the power consumption can be restrained.

In the driving voltage waveform generating circuit in the modification, the switches between the power source unit and the capacitors (the switch indicated as "A" in the drawing) is disconnected when regenerating the charges of the piezoelectric elements to the capacitors. In this configuration, such probability that the charges of the piezoelectric elements cannot be collected because the charges of the piezoelectric elements flow to the power source unit, or the charges flow from the power source unit to the capacitors can be avoided and, consequently, the charges of the piezoelectric elements can reliably be regenerated.

Although the fluid ejection device in this embodiment has been descried, the invention is not limited to all the embodiment and the modifications described above, and various modes can be employed without departing the scope of the invention. For example, a printing apparatus having a larger ejection head (so-called line head printer, etc.) is also applicable. In the case of the printing apparatus as described above, the number of piezoelectric elements is increased with increase in size of the ejection head. Therefore, the power consumption is increased, and hence the apparatus may be upsized for the heat-discharging measure. Therefore, by the application of the invention, the power consumption can be restrained and hence the upsizing of the apparatus can be avoided. Also, since the ejection of the ink drops having the adequate size from the large ejection head is achieved, the high-quality images can be printed quickly. In addition, by applying the driving voltage waveform while correcting the variations in characteristic of the piezoelectric elements and the ejection ports, lowering of the image quality due to the variations in characteristics is avoided even when the number of the ejection ports or the piezoelectric elements is increased, so that quicker printing of the image is achieved by increasing the number of the ejection ports.

What is claimed is:

1. A fluid ejection device configured to eject fluid from an ejection port comprising:

a driving element configured to pressurize the fluid and cause the same to be ejected from the ejection port by being driven according to a voltage applied thereto;

a driving voltage waveform selecting unit configured to select a driving voltage waveform to be applied to the driving element from among a plurality of types of the stored driving voltage waveforms;

a plurality of power sources which are able to set the voltage to be output;

a power source voltage determining unit configured to determine voltages to be set to the plurality of power sources on the basis of the selected driving voltage waveform;

a driving voltage waveform applying unit configured to apply the selected driving voltage waveform to the driving element by setting the determined voltages to the plurality of power sources and switching among the plurality of power sources to connect to the driving element; and a power source switching timing storing unit configured to store timings to switch the plurality of power sources and connect the same to the driving element in coordination with the plurality of types of the driving voltage waveforms, wherein the driving voltage waveform applying unit switches the plurality of power sources at the timings coordinated with the selected driving voltage waveform.

2. The fluid ejection device according to claim 1, wherein the driving element is an element which is capable of storing electric energy, an electric storage unit capable of storing the electric energy is connected in parallel to at least one of the plurality of power sources with the power source, and the driving voltage waveform applying unit regenerates the electric energy in the driving element to the electric storage unit by connecting the power source having the electric storage unit connected thereto to the driving element.

* * * * *